United States Patent [19]

Leatham et al.

[11] Patent Number: 4,938,275

[45] Date of Patent: Jul. 3, 1990

[54] PRODUCTION OF SPRAY DEPOSITS

[75] Inventors: Alan G. Leatham, Bishopston; Jefferey S. Coombs, Neath, both of Wales; Paul B. Davis, Swansea, United Kingdom

[73] Assignee: Osprey Metals Limited, Wales

[21] Appl. No.: 318,426

[22] Filed: Mar. 1, 1989

Related U.S. Application Data

[63] Continuation of Ser. No. 929,442, Nov. 12, 1986, abandoned.

[30] Foreign Application Priority Data

Nov. 12, 1985 [GB] United Kingdom ..... 8527853
Nov. 12, 1985 [GB] United Kingdom ..... 8527855

[51] Int. Cl.[5] ..... B22D 23/00
[52] U.S. Cl. ..... 164/46; 118/320
[58] Field of Search ..... 164/46; 118/320, 321

[56] References Cited

U.S. PATENT DOCUMENTS

| | | | |
|---|---|---|---|
| 2,762,093 | 9/1956 | Hood | 164/46 |
| 4,066,117 | 1/1978 | Clark et al. | 164/46 |
| 4,102,663 | 7/1978 | Jung | 427/193 X |
| 4,239,015 | 12/1980 | Novello et al. | 118/321 |
| 4,250,943 | 2/1981 | Rabinovitch et al. | 164/46 X |
| 4,697,631 | 10/1987 | Bungeroth et al. | 164/46 |

FOREIGN PATENT DOCUMENTS

| | | | |
|---|---|---|---|
| 2445691 | 4/1976 | Fed. Rep. of Germany | 164/46 |
| 58-61947 | 4/1983 | Japan | 164/46 |
| 511995 | 6/1976 | U.S.S.R. | 164/46 |
| 1379261 | 1/1975 | United Kingdom | 164/46 |

*Primary Examiner*—Kuang Y. Lin
*Attorney, Agent, or Firm*—Roylance, Abrams, Berdo & Goodman

[57] ABSTRACT

A method and apparatus for the production of spray deposited ingot, disc or bar is provided it which a spray of gas atomized molten metal or metal alloy particles generated with an atomizing device is directed onto a collector. The collector is rotated about an axis of rotation and a controlled amount of heat is extracted from the atomized particles in flight and on deposition. In order to maintain a substantially constant distance between the atomizing device and the surface of the deposited metal or metal alloy there is relative movement between the atomizing device and the collector. The spray is directed so that the main axis of the spray and the axis of rotation of the collector are inclined at an angle to one another; and the spray is oscillated so that the main axis of the spray oscillates relative to the axis of rotation of the collector. By the method of the invention the shape of deposit is not dependent on the shape or physical containment of the collector, for example, a mould as used in a casting process is not required.

9 Claims, 5 Drawing Sheets

PRODUCTION OF SPRAY DEPOSITS

This is a continuation of application Ser. No. 06/929,442 filed Nov. 12, 1986 and now abandoned.

This invention relates to method and apparatus for the production of spray deposited ingots, discs, billet or bar.

At present a disc or ingot can be formed by directing a spray of gas atomised molten metal or metal alloy at a collector which is tilted at an angle to the spray axis in order to provide a more favourable angle of impingement of the atomised particles onto the already deposited metal. The collector is rotated and simultaneously oscillated and may be moved away from the spray to maintain a constant spray distance. For example U.S. Pat. No. 4066117 discloses such an apparatus but in that arrangement it is essential that the collector is a mould includes side walls. As clearly indicated in FIG. 11 of that patent, when the depth of the mould is exceeded, the dimensional control of the deposit is completely lost. Another problem, even if the deposit were to continue to be built up in the uncontrolled manner, would be that, as the collector is tilted at an angle, the centre of gravity of the deposit the collector so making the deposit unstable and reciprocation of the collector more difficult, if not impossible.

According to the present invention a method for the production of spray deposited ingot, disc or bar comprises the steps of generating a spray of gas atomised molten metal or metal alloy particles with an atomising device, directing the spray onto a collector, rotating the collector about an axis of rotation, extracting a controlled amount of heat from the atomised particles in flight and on deposition, effecting relative movement between the atomising device and the collector in order to maintain a constant distance between the atomising spray head and the surface of the deposited metal or metal alloy, directing the spray so that the main axis of the spray and the axis of rotation of the collectorare inclined at an angle to one another and, oscillating the spray so that the main axis of the spray oscillates relative to the axis of rotation of the collector.

With this method it is possible to position a collector horizontally or vertically or any other direction.

The invention also includes an apparatus for the production of spray deposited ingot, disc or bar comprising a collector rotatable about an axis of rotation, an atomising device arranged to direct a spray of molten metal or metal alloy at the collector and to oscillate the spray across the surface of the collector or the deposit building up thereon with the main axis of the spray and the collector being inclined at an angle to one another, and means for effecting relative movement between the atomising device and the collector.

The atomising device is preferably a device including means movable relative to the stream of liquid metal from which the spray is formed whereby movement is imparted to the spray.

The invention will now be described by way of example with reference to the accompanying diagrammatic drawings in which.

Figure 1:
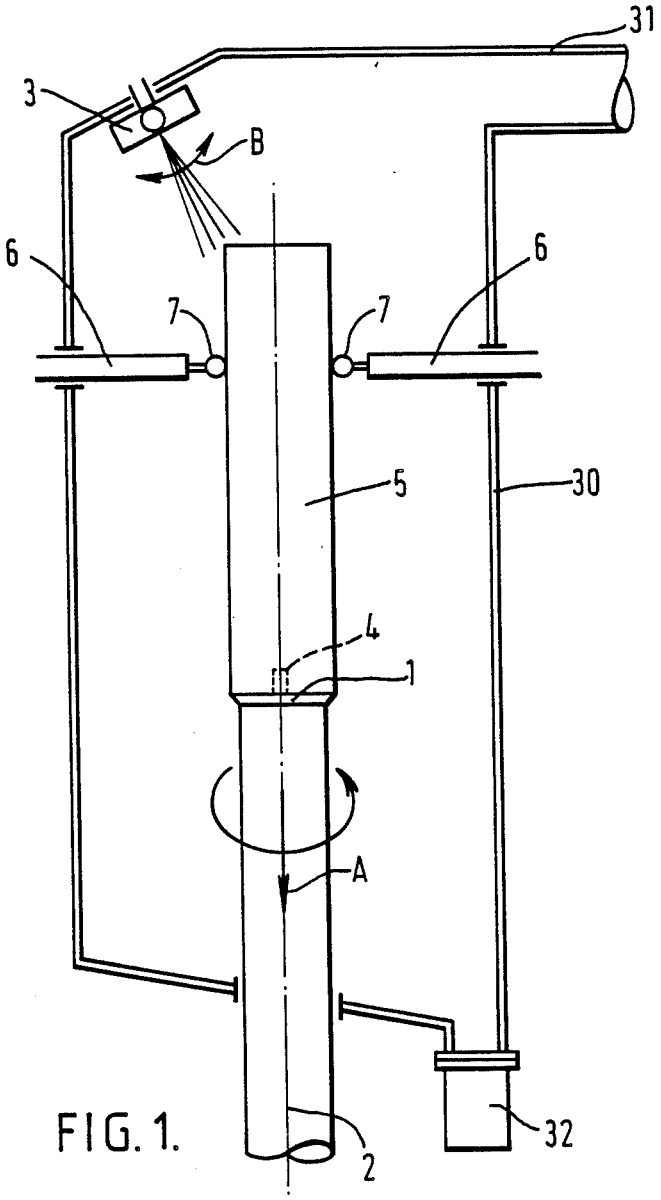
FIG. 1 illustrates one embodiment of the invention applied to the formation of bar.

In FIG. 1 a collector 1 is rotatable about an axis of rotation 2 and is movable along said axis as indicated by the arrow A. An atomising device 3 is positioned so as to be inclined to the axis of rotation 2 so that the spray of metal or metal alloy droplets created by the atomising device 3 arrives at the surface of the collector at an angle to the axis of rotation. The atomising device 3 is arranged to tilt about an axis passing through the atomiser so that the main axis of the spray oscillates across the surface of the collector and the deposit building up thereon as indicated by the arrow B. As the deposit increases in size the collector 1 is withdrawn so that the distance between the surface of the deposit and the atomising device remains substantially constant.

In order to key the deposit to the collector 1, the collector 1 is suitably formed with a central projection 4 (or depression) about which the initial layers of the deposit form. Moreover, as the deposit 5 grows in size, the deposit may be stablised by side stabilising devices 6 which include bearing rollers 7 to allow continued withdrawal as the deposit increases in size. After the initial support provided by the collector 1 the diameter or cross-sectional shape of the deposit, within limits, is substantially determined and controlled by the movements of the spray, the rate of withdrawal of the collector and the rate of deposition. Providing the metal or metal alloy being deposited is in the correct "state" at and on deposition i.e. the correct and controlled amount of heat has been extracted including the superheat and a large proportion or all of the latent heat, a mould to apply predetermined dimensions to the deposit as it builds up is not required.

The heat extraction from the atomised particles before and after deposition occurs in three main stages:

(i) in-flightcooling mainly by convective heat transfer to the atomising gas. Cooling will typically be in the range $10^{-3}$–$10^{-6}$°C./sec depending mainly on the size of the atomised particles. (Typically atomised particle sizes are in the size range 1–500 microns);

(ii) on deposition, cooling both by convection to the atomising gas as it flows over the surface of the spray deposit and also by conduction to the already deposited metal; and (iii) after deposition cooling by conduction to the already deposited metal.

It is essential to carefully control the heat extraction in each of the three above stages. It is also important to ensure that the surface of the already deposited metal consists of a relatively thin layer of semi-solid/semi-liquid metal into which newly arriving atomised particles are deposited. This is achieved by extracting heat from the atomised particles by supplying gas to the atomising device under carefully controlled conditions of flow, pressure, temperature and gas to metal ratio and by controlling the further extraction of heat after deposition.

If desired the rate of the conduction of heat on and after deposition may be increased by applying cold injected particles as disclosed in our European patent application published under No. 0198613. In addition a metal matrix composite bar, ingot or disc may be produced by incorporating metallic or non-metallic particles or fibres into the atomised spray.

Figure 2:
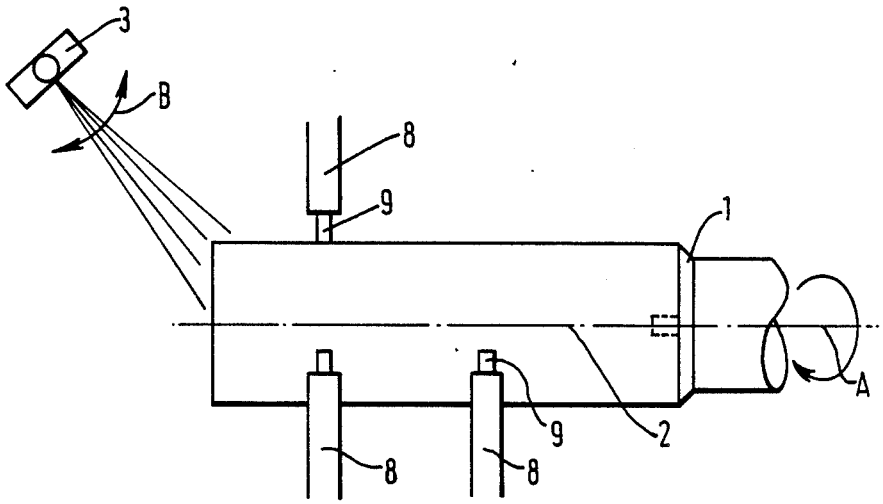
FIG. 2 illustrates a second embodiment of the invention applied to the formation of bar.
Figure 3:
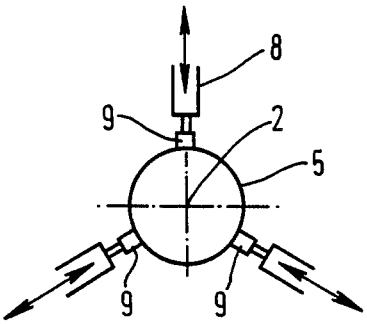
FIG. 3 is an end view in the direction of arrow c in FIG. 2.

In FIG. 2 a similar arrangement to FIG. 1 is shown except that the collector 1 is positioned vertically as opposed to horizontally. This arrangement is preferable for continuous production methods but additionally requires stabilising supports 8, similar to the stabilising devices 6 which hold the formed bar as it is withdrawn in the direction of arrow A in order to maintain the spray distance between the atomising device 3 and the surface of the deposit substantially constant. As seen from FIG. 3 and the arrows included on the stabilising supports 8, the stabilising supports 8 are movable axially so that end bearing rollers 9 can accommodate surface irregularities without preventing continued withdrawal of the deposit.

Figure 4:
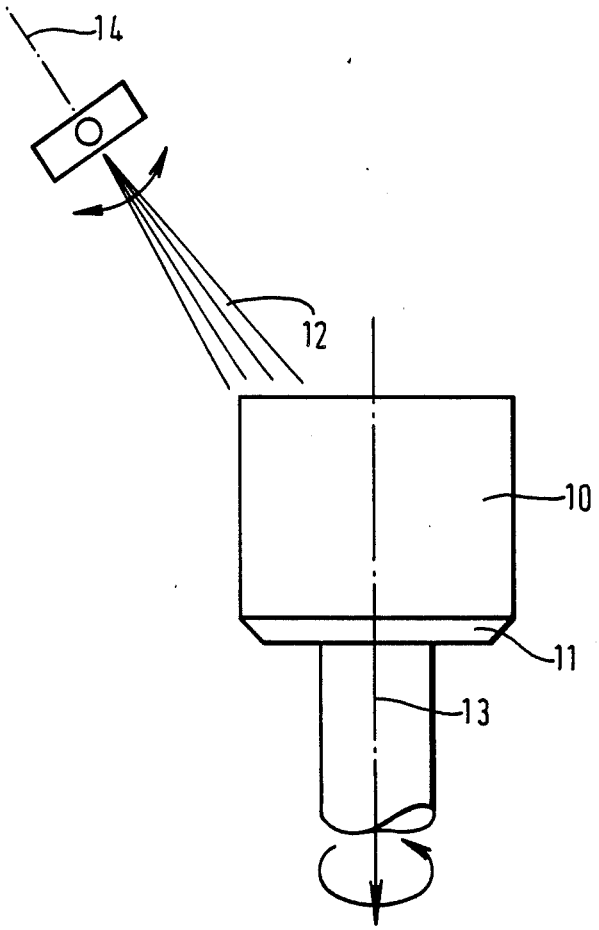
FIG. 4 shows a further embodiment of the invention as applied to a disc or ingot.

In FIG. 4 a disc or ingot deposit 10 is formed on a collector 11 which is rotated under the spray 12 about an axis 13 transverse to the mean axis 14 of the spray. As with the embodiment of FIG. 1, the spray 12 is oscillated as indicated by the arrow so as to scan the surface of the deposit as it is rotated about axis 13. As the deposit 10 builds up on the collector 11, the collector is retracted in an axial direction in order to maintain a substantially constant spray distance.

Figure 5:
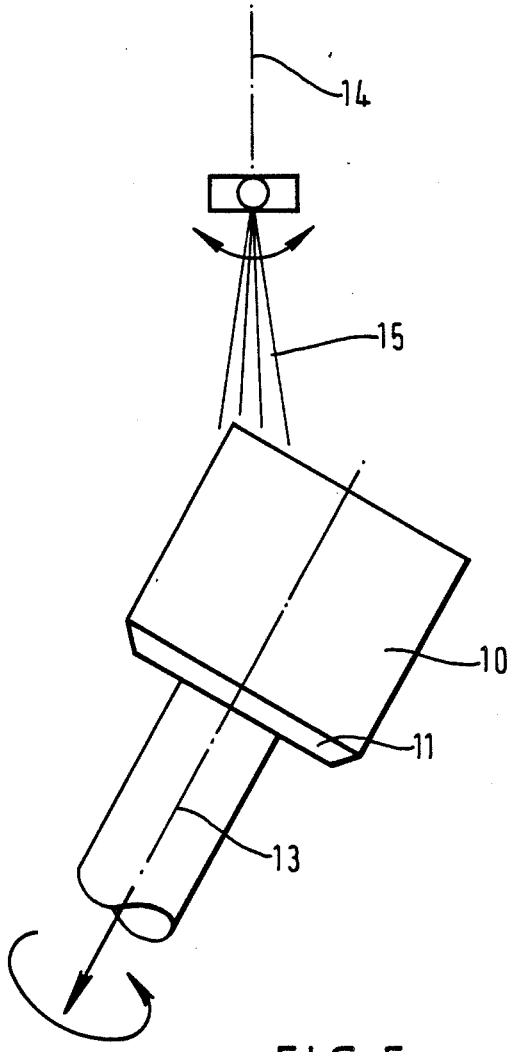
FIG. 5 shows another embodiment of the invention as applied to a disc or ingot.

The arrangement of FIG. 5 is similar to that of FIG. 4 except that the collector and the axis of rotation are inclined to a spray 15 generated so as to have a generally vertical means axis 14. The shape of the deposit is again determined solely by the inter-relationship between the movement of the spray 15, the rate of deposition and the withdrawal of the collector and, after inital deposition, is not dependent in any way on the shape or physical containment of the collector (ie for example a mould as used in a casting process is not required).

The oscillation of the spray in the embodiment is preferably achieved by oscillation of the atomising device itself. For example the atomising device may be as diagrammatically illustrated in FIG. 6 and mounted at an inclined angle.

Figure 6:
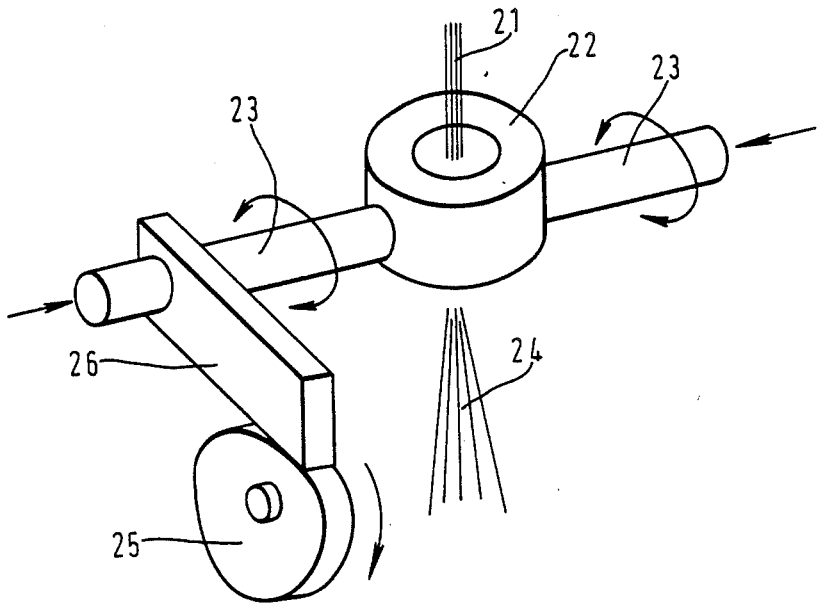
FIG. 6 illustrates a diagrammatic view of apparatus for moving the spray.

In FIG. 6 a metal stream 21 is teemed through an atomising device 22. The device 22 is generally annular in shape and is supported by diametrically projecting supports 23. The supports 23 also serve to supply atomising gas to the atomising device in order to atomise the stream 21 into a spray 24. In order to impart movement to the spray 24 the projection supports 23 are mounted in bearings (not shown) so that the whole atomising device 22 is able to tilt about the axis defined by the projecting supports 23. The control of the tilting of the atomising device 22 comprises an eccentric cam 25 and a cam follower 26 connected to one of the supports 23. By altering the speed of rotation of the cam 25 the rate of oscillation of the atomising device 22 can be varied. In addition, by changing the surface profile of the cam 25, the speed of oscillation at any instant during the cycle of cam 25, can be varied. The oscillation can be of the order of 5 to 30 cycles per second for obtaining a particular desired shape to a deposit. Full details of the preferred apparatus may be obtained from our co-pending application filed herewith to which reference is directed.

The oscillations of the spray are suitably a to and fro motion so that, as the collector rotates, a deposition pattern is created on the already deposited metal. If the speed of oscillation relative to the speed of collector rotation is kept low, the patterns can be made discernable by arranging for the oscillations per revolution to be in phase with the rotation of the collector. If the number of oscillations is, say exactly four per revolution, a deposit with four axes of symmetry can be formed, for example square bar. Alternatively, the cross-section of the deposit may be effected by varying the speed of rotation and the spread of the oscillation of the spray such that the whole surface of the deposit is substantially covered at some time during the cycle by the main axis of the spray. The size of the deposit is determined as a function of the rate of withdrawal and the metal deposition rate. Although, the atomising conditions can be maintained substantially constant some variations may occur in practice. Accordingly, in order to maintain a constant size of bar, the diameter or cross-sectional area may be monitored and the speed of withdrawal varied to compensate for, for example, changes in metal flow rate.

Whilst the invention has been particularly described with reference to moving the collector, it will be understood that it may be desirable alternatively to raise the atomising device instead in order to maintain a substantially constant spray distance. Moreover, for simplicity, the chamber in which spray deposition takes place has been omitted from all the Figures except FIG. 1. In that Figure a chamber 30 is shown for providing a desired atmosphere such as, an inert atmosphere, atomising gas is exhausted at 31, and any overspray powder is collected at 32.

I claim:

1. A process for forming an ingot having a length at least twice as great as a characteristic sectional dimension hereof, comprising the steps of:

spraying droplets of molten metal from spray means and in a first direction; positioning an element having a catching surface in the path of said sprayed droplets; rotating said catching surface about an axis angularly spaced from said first direction by between 90° and 180°, whereby said sprayed droplets are evenly applied to said catching surface to form a continuous agglomerate and, when said catching surface is covered by said agglomerate, said sprayed droplets are evenly applied to a catching surface of said agglomerate such that the agglomerate is self-supporting; continuously moving said agglomerate along said axis as said sprayed droplets are applied and at a rate such that said catching surface remains at a constant distance from said spray means, whereby a longitudinal ingot surface is formed by said continuous agglomerate, and determining the shape of the agglomerate without physical containment by the interrelationship between the movement of the catching surface and the movement of the spray.

2. A method according to claim 1 wherein the catching surface of the agglomerate remains at a constant distance from the spray means by withdrawing the agglomerate in the direction of said axis of rotation.

3. A process according to claim 1 wherein the spray of droplets is oscillated during application to the catching surface of the element and subsequently to the catching surface of the agglomerate.

4. A process for forming an ingot or bar having a length at least twice as great as characteristic sectional dimension hereof, comprising the steps of:

spraying droplets of molten metal or metal alloy from spray means and in a first direction; positioning an element having a catching surface in the path of the sprayed droplets; oscillating the sprayed droplets;

rotating the element catching surface about an axis angularly spaced from the first direction by between 90° and 180°, whereby the sprayed droplets are applied to the element catching surface under substantially uniform deposition conditions to form a continuous agglomerate; extracting heat from the sprayed droplets in flight and on deposition in order to provide and maintain a catching surface of the agglomerate comprising a relatively thin layer of semi-solid/semi-liquid metal whereby, when the element catching surface is covered by the agglomerate, the sprayed droplets are applied to the catching surface of the agglomerate, such that the agglomerate is self-supporting; continuously moving the agglomerate along said axis as the sprayed droplets are applied and at a rate such that the agglomerate catching surface remains at a substantially constant distance from the spray means, whereby a longitudinal ingot surface is formed by the continuous agglomerate, and determining the shape of the agglomerate without physical containment by the interrelationship between the movement of the catching surface and the movement of the spray.

5. Apparatus for forming an ingot having a length at least twice as great as a characteristic sectional dimension hereof, comprising:

spray means for spraying droplets of molten metal in a first direction; an element having a catching surface for positioning in the path of said sprayed droplets; means for rotating said catching surface about an axis angularly spaced from said first direction by between 90° and 180°, whereby said sprayed droplets may be evenly applied to said catching surface to form a continuous agglomerate and, when said catching surface is covered by said agglomerate, said sprayed droplets may be evenly applied to a catching surface of said agglomerate such that the agglomerate is self-supporting; means for continuously moving said agglomerate along said axis as said sprayed droplets are applied and at a rate such that said catching surface remains at a constant distance from said spray means, whereby a longitudinal ingot surface is formed by said continuous agglomerate without physical containment by the interrelationship between the movement of the catching surface and the movement of the spray; and stabilizing means, remote from the catching surface, for stabilizing the agglomerate as it grows in size.

6. Apparatus for forming an ingot or bar having a length at least twice as great as a characteristic sectional dimension hereof, comprising:

spray means for spraying droplets of molten metal or metal alloy in a first direction; an element having a catching surface for positioning in the path of the sprayed droplets; means for oscillating the sprayed droplets; means for rotating the element catching surface about an axis angularly spaced from the first direction by between 90° and 180°, whereby the sprayed droplets are applied to the element catching surface under substantially uniform deposition conditions to form a continuous agglomerate; control means for controlling the extraction of heat from the sprayed droplets in flight and on deposition in order to provide and maintain a catching surface of the agglomerate comprising a relatively thin layer of semi-solid/semi-liquid metal whereby, when the element catching surface is covered by the agglomerate, the sprayed droplets are applied to the catching surface of the agglomerate such that the agglomerate is self-supporting; means for continuously moving the agglomerate along said axis as the sprayed droplets are applied and at a rate such that the agglomerate catching surface remains at a substantially constant distance from the spray means, whereby a longitudinal ingot surface is formed by the continuous agglomerate without physical containment by the interrelationship between the movement of the catching surface and the movement of the spray; and stabilizing means remote from the catching surface for stabilizing the agglomerate as it grows in size.

7. Apparatus according to claim 6 wherein the element catching surface is substantially horizontal.

8. Apparatus according to claim 6 wherein the element catching surface is substantially vertical.

9. Apparatus according to claim 6 wherein the means for oscillating the sprayed droplets comprises control means for controlling movement of the spray means selected from; a co-operable cam and cam follower, a program controlled stepper motor, and a program controlled electro-hydraulic servo-mechanism.

* * * * *